US006282914B1

(12) United States Patent
Steinhoff et al.

(10) Patent No.: US 6,282,914 B1
(45) Date of Patent: Sep. 4, 2001

(54) UNDER COUNTER REFRIGERATION UNIT

(75) Inventors: Paul Matthew Steinhoff; William C. Betke, Jr., both of Asheville; Abraham Charles Narehood, Weaverville, all of NC (US)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/322,419

(22) Filed: May 28, 1999

(51) Int. Cl.[7] ..... F25D 23/00
(52) U.S. Cl. ..... 62/302; 62/258; 62/441
(58) Field of Search ..... 62/258, 302, 441

(56) References Cited

U.S. PATENT DOCUMENTS

| | | | | |
|---|---|---|---|---|
| 2,948,498 | * | 8/1960 | Johnsen et al. | 62/302 |
| 3,058,320 | * | 10/1962 | Foster et al. | 62/302 |
| 3,178,902 | * | 4/1965 | Costantini et al. | 62/302 |
| 3,206,943 | * | 9/1965 | Rice et al. | 62/302 |
| 3,210,957 | * | 10/1965 | Rutishauser et al. | 62/302 |
| 3,230,733 | * | 1/1966 | Rutishauser et al. | 62/302 |
| 3,323,625 | * | 6/1967 | Webster | 62/302 |
| 3,772,898 | * | 11/1973 | Anderson | 62/302 |
| 4,019,339 | * | 4/1977 | Anderson | 62/255 |
| 4,706,466 | * | 11/1987 | Yingst et al. | 62/138 |

* cited by examiner

*Primary Examiner*—William Doerrler
*Assistant Examiner*—Mark Shulman
(74) *Attorney, Agent, or Firm*—Pepper Hamilton LLP

(57) ABSTRACT

An under the counter refrigeration unit (20), having a support frame (24), refrigerator cabinet (26), automatically opening lid (28), slide mechanism (32), and anti-racking assembly (86), is utilized to provide controlled temperature storage without occupying previously unused floor space or counter top (34) work area. The refrigerator cabinet (26) has an open top (60), and the slide mechanism (32) utilizes four drawer slides interposed between the support frame (24) and the refrigerator cabinet (26). The automatic lid opening mechanism (118) utilizes pins (132, 134) attached to opposite sides of the lid (28) and extending outwardly into inclined slots (122, 126). As the pins (132, 134) move to upper ends (128) of the slots (122, 126) the lid (28) is automatically lifted off the top (60) of the refrigerator cabinet (26).

20 Claims, 7 Drawing Sheets

UNDER COUNTER REFRIGERATION UNIT

FIELD OF THE INVENTION

This invention relates to refrigeration units and, more particularly, to refrigeration units used in environments with limited floor space and which also require relatively large counter top work areas.

BACKGROUND OF THE INVENTION

Most laboratories, biomedical institutions, and testing laboratories have limited, and sometimes insufficient, temperature controlled storage space available for refrigerated storage of laboratory materials such as biological specimens. One reason for this lack of temperature controlled storage space, is that these facilities have limited floor space and require large counter top work areas. Typical refrigeration units occupy substantial quantities of either floor or counter top space making installation of additional refrigeration units at the facilities an inadequate solution, and because the materials cannot be transported relatively long distances back and forth between a storage unit and a work area without compromising the materials or unacceptable inconvenience, installation of refrigeration units at remote locations in or near the facilities is also an inadequate solution. Thus, providing additional and conveniently located temperature controlled storage space without diminishing the useable amount of floor space and counter top work area is desirable to increase facilities temperature controlled storage capacity while supporting additional laboratory personnel.

BRIEF SUMMARY OF THE INVENTION

There is, therefore, provided in the practice of the invention a novel refrigeration unit, which is slidably mounted underneath a laboratory counter, providing conveniently located, temperature controlled storage space for laboratory materials. The refrigeration unit includes a refrigerator cabinet defining an interior cavity for storing laboratory materials. A refrigeration system is provided to control the temperature in the interior cavity, and a slide mechanism is operably coupled with the refrigerator cabinet to slide the refrigerator cabinet between a stored position under a counter top and an accessible position adjacent the counter top.

In a preferred embodiment, the refrigeration unit also includes a support frame for being fixedly mounted under a counter top, and the slide mechanism is operably coupled to both the support frame and the refrigerator cabinet; so that the refrigerator cabinet slides relative to the support frame between the stored and accessible positions. A lid is also provided, and an opening mechanism openably couples the lid with the open top of the refrigerator cabinet. Preferably, the opening mechanism automatically opens the lid when the refrigerator cabinet is being moved to the accessible position. The opening mechanism includes a pair of opposed forward flanges and a pair of opposed rearward flanges. Each flange defines a slot having a forward upper end and a rearward lower end. Four pins extend from the sides of the lid and are slidably received in the slots, so that the lid moves to an upper open position when the refrigerator cabinet is moved forwardly toward the accessible position. An alignment catch extends downwardly from the lid and engages the rear of the refrigerator cabinet, and as the refrigerator cabinet slides rearwardly towards the stored position, the catch forces the lid to move to a lower closed position. Preferably, a biasing member engages the lid and biases the lid toward the open position.

The slide mechanism preferably comprises a plurality of drawer slides, and an anti-racking assembly is interposed between the support frame and the refrigerator cabinet to inhibit rotation of the refrigerator cabinet relative to the support frame. The support frame has a frame bottom which is higher than the bottom of the refrigerator cabinet, leaving an open toe kick space below the refrigerator cabinet.

The above-described refrigeration unit is preferably used in combination with a laboratory counter including a counter top work surface and a support body holding the work surface above a floor to define an open area under the work surface. The support frame is fixedly mounted under the counter top in the open area, and the refrigerator cabinet is substantially entirely under the counter top when it is in the stored position. When the automatic lid opening mechanism is utilized, a substantial portion of the lid is still under the counter top when the lid is in the open position. The laboratory counter also includes a back wall, and the refrigeration system is positioned between the back wall and the refrigerator cabinet. The front of the refrigerator unit includes an air intake adjacent a side of the refrigerator cabinet. Air is exhausted at the support frame bottom through the toe kick space.

Accordingly, it is an object of the present invention to provide an improved under the counter refrigeration unit for providing additional temperature controlled storage space without sacrificing counter top work area or floor space.

It is another object of the present invention to provide an improved under the counter refrigeration unit in combination with a laboratory counter.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figure 1:
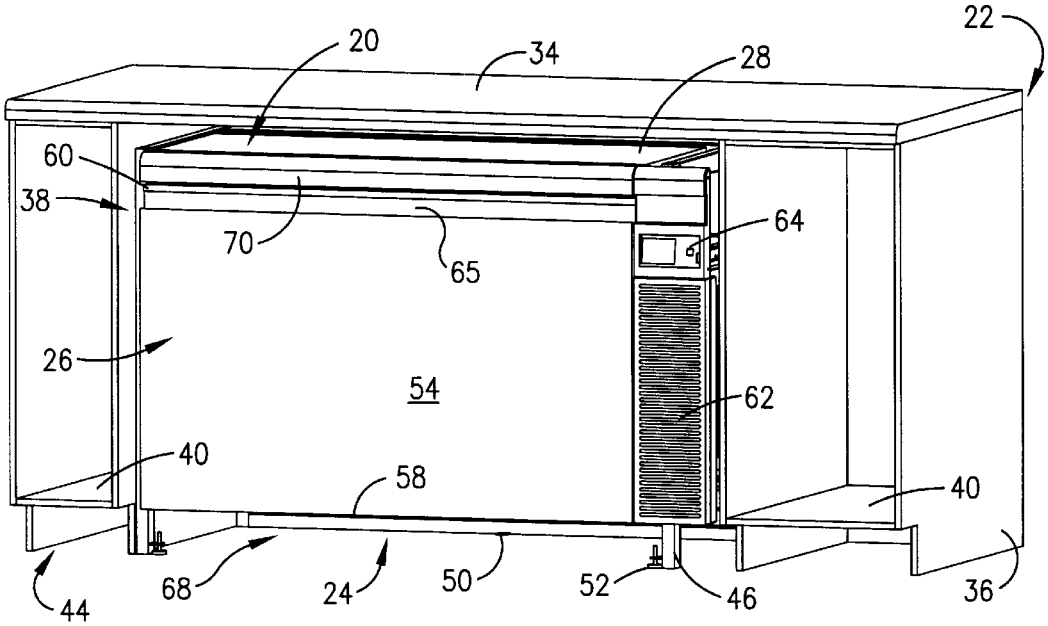
FIG. 1 is a front perspective view of an under counter refrigeration unit, according to the present invention, shown in a stored position under a counter top work area of a laboratory counter.

Referring to the drawings in greater detail, FIGS. 1 through 4 show an under the counter refrigeration unit 20 positioned under a laboratory counter 22. The refrigeration unit has a support frame 24, a refrigerator cabinet 26, a lid 28, and a refrigeration system 30 to control the temperature in the refrigerator cabinet 26. A slide mechanism 32 is operably coupled with the refrigerator cabinet 26 and support frame 24, so that the refrigerator cabinet 26 slides between a stored position under the counter 22 and an accessible position adjacent the counter 22.

Figure 2:
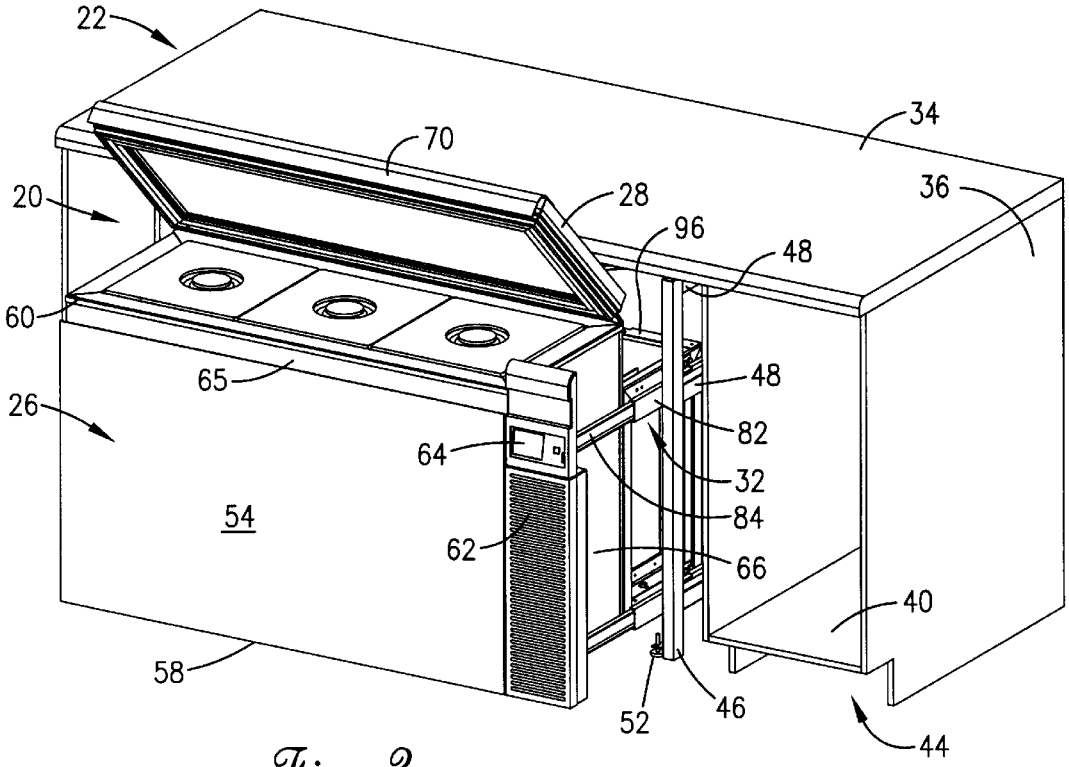
FIG. 2 is a front perspective view of the under counter refrigeration unit of FIG. 1 shown in an accessible position.
Figure 4:
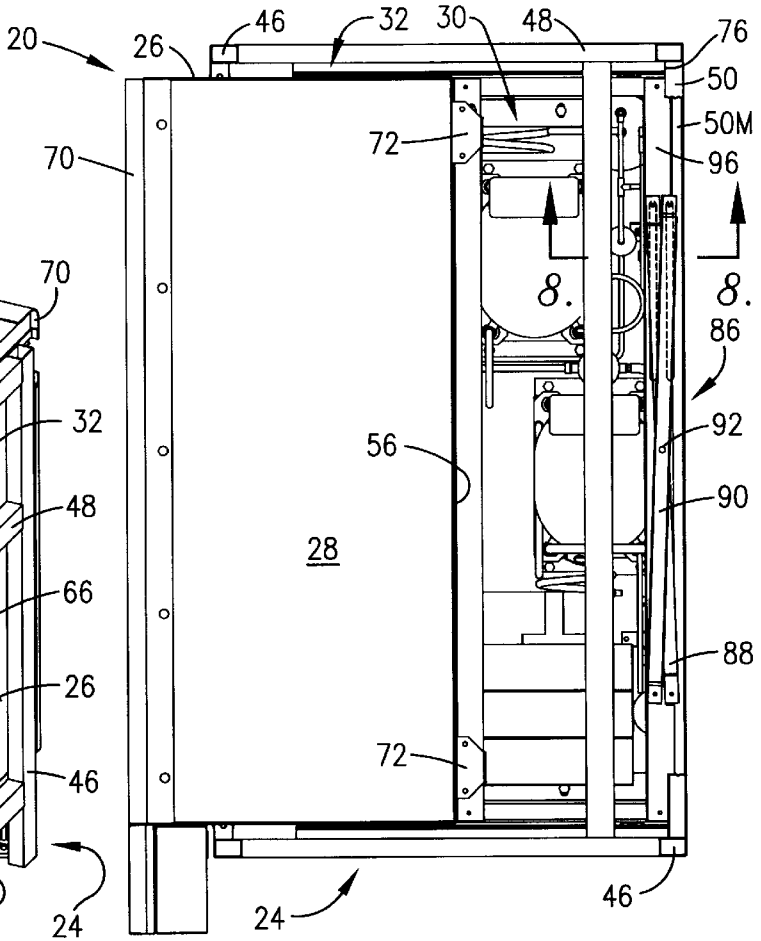
FIG. 4 is a top view of the under counter refrigeration unit of FIG. 1.
Figure 5:
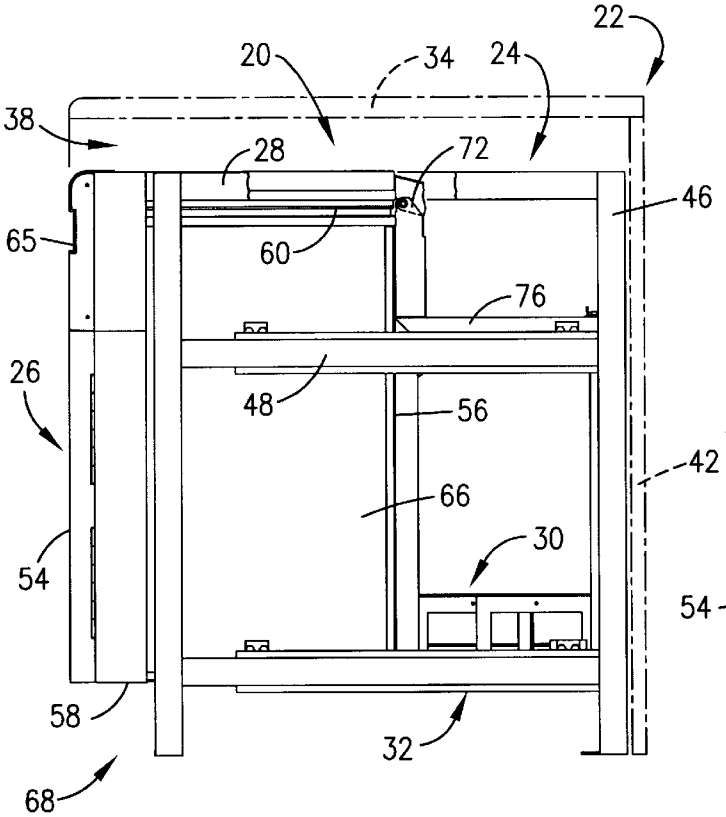
FIG. 5 is a side view of the under counter refrigeration unit of FIG. 1.

Referring to FIGS. 1, 2, and 5, the laboratory counter 22 includes a counter top work surface 34 and a support body 36 holding the top work surface 34 above the floor to define an open area 38 under the top work surface 34. The laboratory counter is largely conventional and can be provided with bottom shelves 40 in the support body 36. Alternatively, the counter 22 could be provided with drawers (not shown) above the bottom shelves 40. The bottom front of the support body 36 is recessed toward a back wall 42 (FIG. 5) of the support body 36 leaving a toe kick opening 44 in the support body 36.

Figure 3:
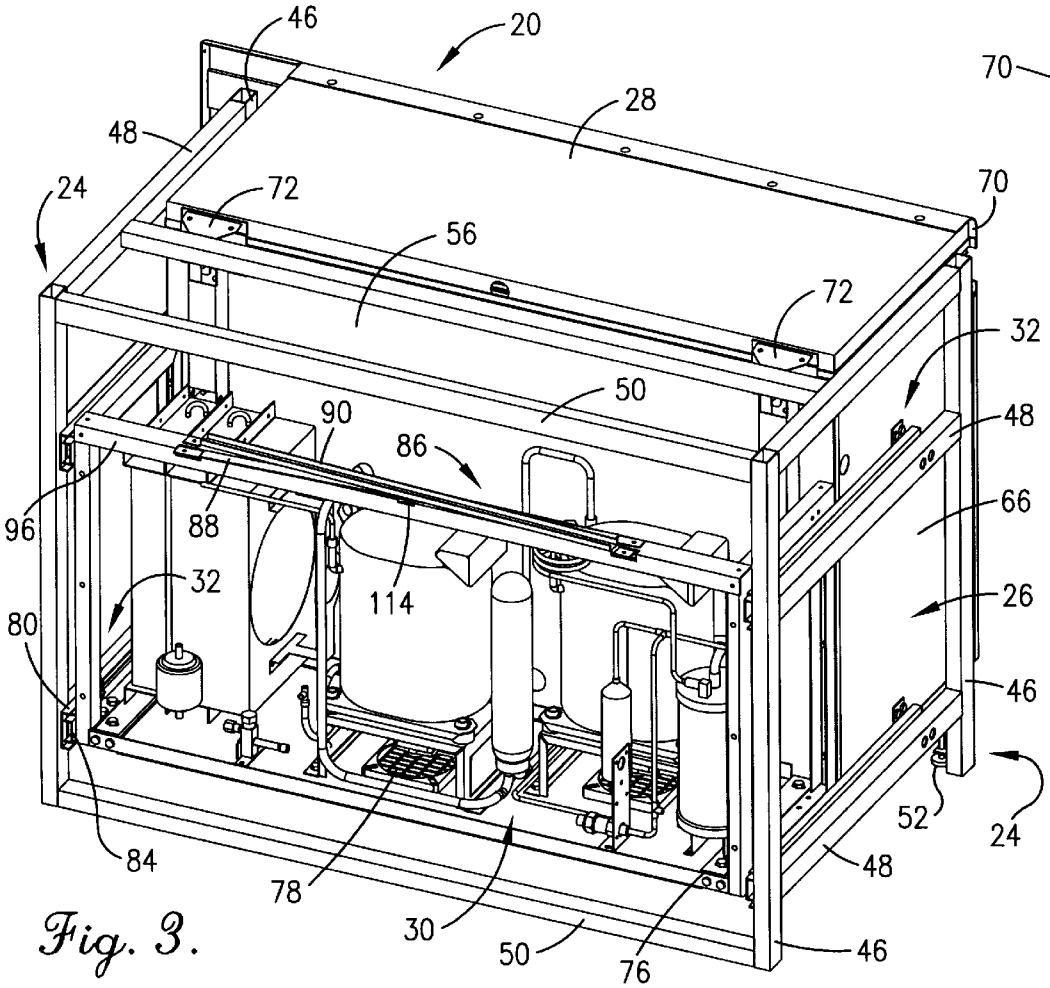
FIG. 3 is a rear perspective view of the under counter refrigeration unit of FIG. 1.

Referring to FIGS. 1 and 3, the support frame 24 for the refrigeration unit 20 includes four legs 46, a plurality of side cross members 48, and a plurality of rear cross members 50. The cross members are preferably horizontal, and the legs are preferably vertical. If desired, leveling feet 52 are attached to the legs 46 near the bottom of the support frame. The depth of the support frame is selected, so that the legs 46 are not positioned beyond the toe kick opening 44 in the support body 36 of the laboratory counter 22. Thus, the support frame is fixedly mounted entirely under the counter top 34. The support frame 24 can be attached to the support body 36 or it can stand independently of the support body 36. If desired, the rear legs of the support frame 24 are attached to the floor surface, so that the refrigeration unit does not tip when the refrigerator cabinet is moved to the accessible position. Alternatively, the legs are adjustable in length to engage both the floor and the counter top 34.

Referring additionally to FIG. 2, the refrigerator cabinet 26 is preferably vacuum insulated and has a front 54, rear 56, bottom 58, and open top 60. The refrigerator cabinet defines an interior cavity of one to five cubic feet for receiving laboratory materials to be stored. Because the opening to the refrigerator cabinet 26 is provided through the open top 60, there is a minimal loss of cool air when the lid 28 is opened. Thus, the refrigerator cabinet 26 of the present invention is more efficient than a refrigerator cabinet having an opening front, which would allow the dense cold air to flow downwardly out of the interior cavity of the refrigerator cabinet. The front 54 of the cabinet 26 is approximately aligned with the front of the lab counter 22 when the refrigerator cabinet is in the stored position. The front 54 includes an air intake vent 62 and controls 64 for operating and controlling the refrigeration system 30. The vent is next to a side 66 of the refrigerator cabinet 26. The front 54 of the refrigerator cabinet also includes a handle 65 which is configured to be grasped by an operator to pull the refrigerator cabinet 26 from the stored position to the accessible position. The sides 66 of the refrigerator cabinet 26 are positioned within the side cross members 48 of the support frame 24. The bottom 58 of the refrigerator cabinet 26 is held above the floor by the support frame 24, so that the refrigerator cabinet does not extend into the toe kick area 44 of the lab counter 22. Thus, the refrigerator cabinet 26 is higher than the bottom of the support frame 24 to provide a toe kick space 68 under the refrigerator cabinet 26.

Figure 6:
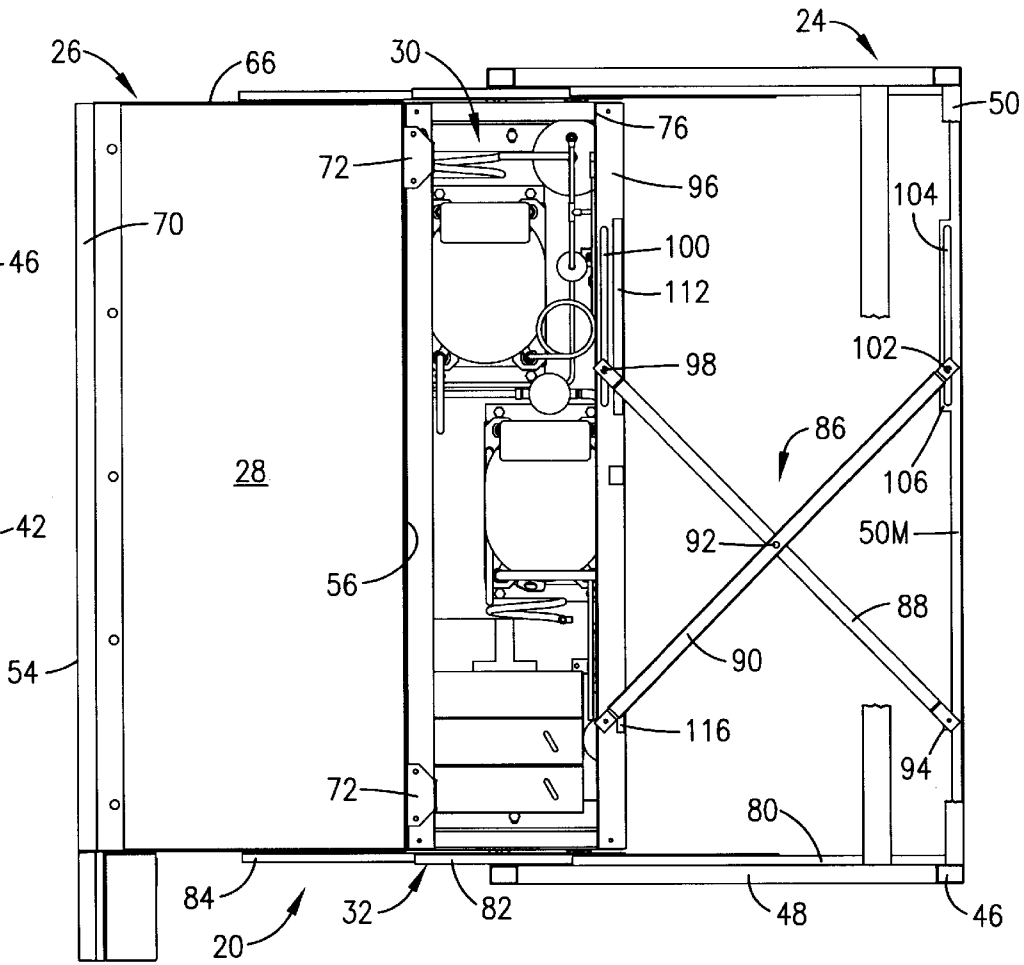
FIG. 6 is a top view of the under counter refrigeration unit of FIG. 1 illustrated in the accessible position.
Figure 7:
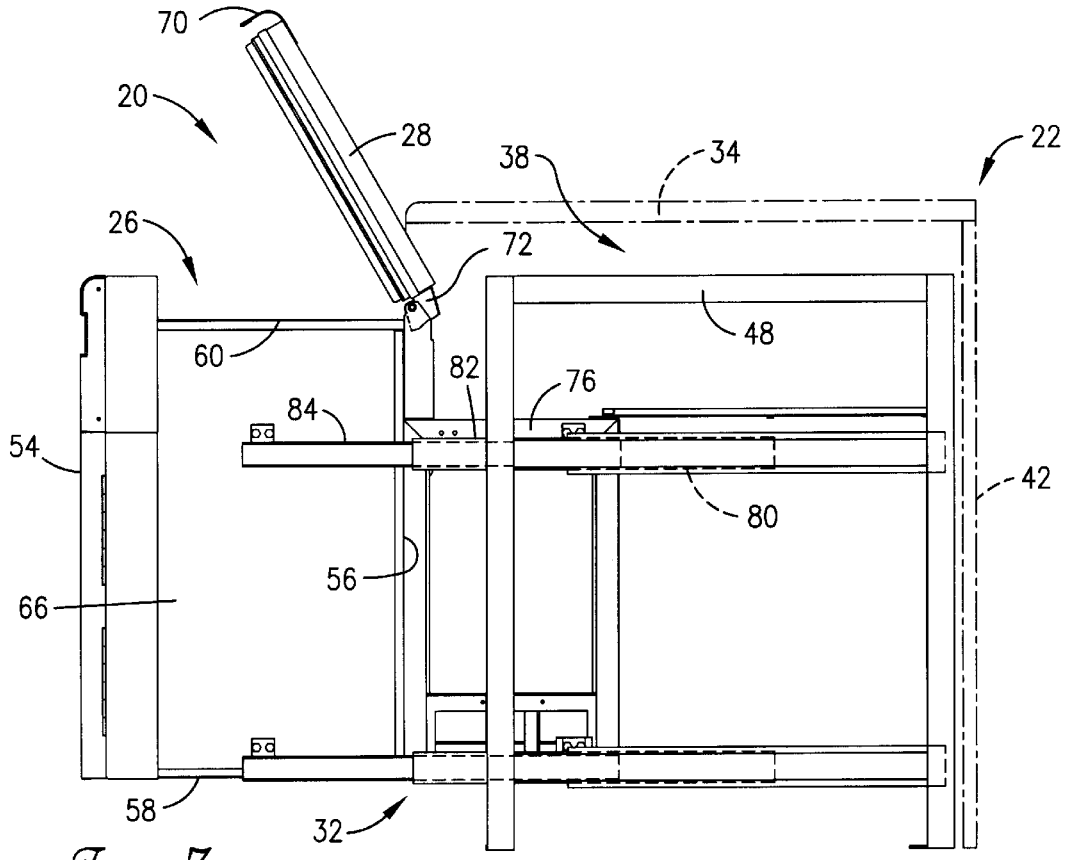
FIG. 7 is a side view of the under counter refrigeration unit of FIG. 1 illustrated in the accessible position.

Referring to FIGS. 2, 6, and 7, the lid 28 is preferably vacuum insulated and is openably coupled with the top 60 of the refrigerator cabinet by an opening mechanism which preferably comprises an outer lid 70 and hinges 72. The outer lid 70 is attached to the body of the lid, so that the outer lid 70 is adjacent to the front 54 of the refrigerator cabinet 26 when the lid is in the closed position. The manually operated hinges 72 hingably attach the lid to the top 60 of the refrigerator cabinet 26 at the rear 56 of the refrigerator cabinet. Preferably, a plurality of sub-lids 74 are also provided to separate individual compartments within the refrigerator cabinet. Thus, when one compartment is opened by removing the sub-lid 74, there is minimal impact on the temperature in the other compartments.

Referring to FIGS. 1 and 3, the refrigeration system 30 is substantially conventional and is mounted in a slidable carriage 76 mounted on the rear 54 of the refrigerator cabinet 26. A preferred refrigeration system is a Standard GSLE ultra-low refrigeration system. The air fed into refrigeration system 30 through the front air intake vent 62, which is positioned adjacent to the side 66 of the cabinet, is exhausted from the system through exhaust port 78 in the bottom of the slidable carriage 76. Thus, air is exhausted from the unit through the toe kick space 68. The refrigeration system 30 is preferably positioned between the back wall 42 of the lab counter 22 and the refrigerator cabinet 26. Thus, the refrigeration system is adjacent to the back wall 42 when the refrigeration unit is in the stored position.

Referring to FIG. 7, the slide mechanism 32 preferably comprises a plurality of drawer slides mounted on the sides of the refrigeration unit 20 and above floor level. The preferred drawer slides are provided by Waterloo Furniture Components and is obtainable by requesting Model No. 3556. The preferred drawer slide includes a base arm 80, an intermediate arm 82, and a distal arm 84. In the preferred embodiment shown, there are four slides operably coupled to the support frame and refrigerator cabinet. Two slides are positioned on each side of the refrigerator cabinet, so that there are two upper slides and two lower slides. The base arms 80 are attached to the side cross members 48 inside the support frame 24. The distal arms 84 are attached to the sides 66 of the refrigerator cabinet and the slidable carriage 76. The intermediate arm 82 and a plurality of bearings (not shown) are interposed between the base and distal arms to allow relative linear motion between the three arms 80–84 of the drawer slides 32. The drawer slides 32 preferably include stops which inhibit over extension and have a strength sufficient to support the weight of the refrigeration unit and its contents without plastic deformation.

Figure 8:
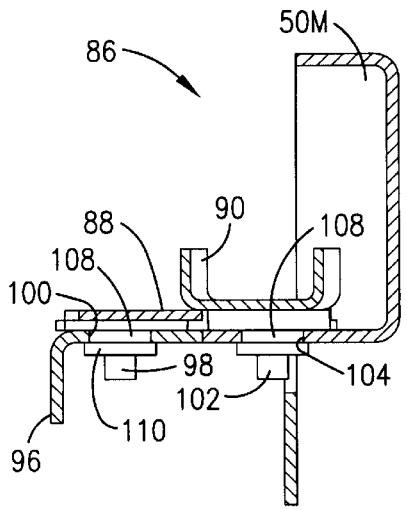
FIG. 8 is a cross sectional view taken along line 8—8 in FIG. 4 of an anti-racking assembly.

Referring to FIGS. 3, 6, and 8, the refrigeration unit 20 is also provided with an anti-racking assembly 86 interposed between the support frame 24 and the refrigerator cabinet 26. Specifically, the anti-racking assembly 86 is attached to the support frame and the sliding carriage 76. The anti-racking assembly 86 includes two pivot arms 88, 90 pivotally connected by a center pivot pin 92 at their mid points. The first pivot arm 88 is pivotally attached to a fixed pivot tab 94 extending from a middle one 50M of the rear cross members which preferably comprises a C-channel. The first pivot arm extends to a carriage, rear cross member 96. A first slide pin 98 extends downwardly from the first pivot arm 88 into a first slot 100 defined in the carriage cross member 96. The second pivot arm 90 is pivotally attached at a fixed location to the carriage cross member 96. The second pivot arm 90 extends to the middle cross member 50M and includes a downwardly extending second slide pin 102 which is slidably received in a second slot 104 defined in a slot tab 106 extending inwardly from the middle cross member 50M. Preferably, bushings 108 are interposed between the slide pins and the respective bearing surfaces of the slots, and snap rings 110 or other securement devices are used to hold the slide pins 98, 102 in the respective slots 100, 104.

As the refrigeration unit slides between its stored and accessible positions, the slide pins 98, 102 slide within the slots 100, 104 and inhibit the rotation of the drawer around a vertical axis to keep the refrigeration unit from binding within the support frame 24. To save space, the carriage cross member 96 includes a slot recess 112, a pivot pin recess 114, and a pivot tab recess 116. When the refrigeration unit 20 is moved to the stored position the slot tab 106 is received in the slot recess; the pivot pin 92 is received in the pivot pin recess 114, and the pivot tab 94 is received in the pivot tab recess 116. To allow the first pivot arm to slide underneath the second pivot arm 90, which is U-shaped for strength, the first pivot arm 88 is substantially flat. Further, the bushings 108 used with the first pivot arm have a thickness allowing the first pivot arm to fit under the second pivot arm.

Figure 10:
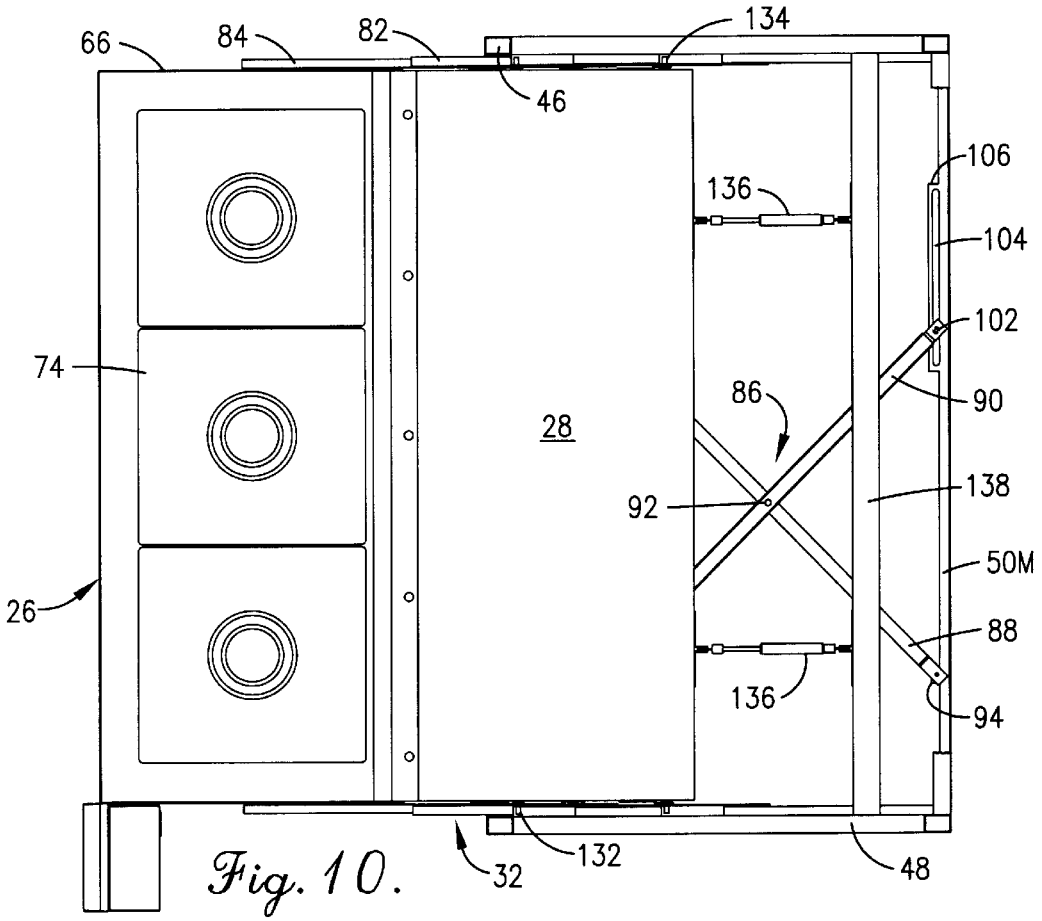
FIG. 10 is a top view of the under counter refrigeration unit of FIG. 9 illustrated in the accessible position.
Figure 13:
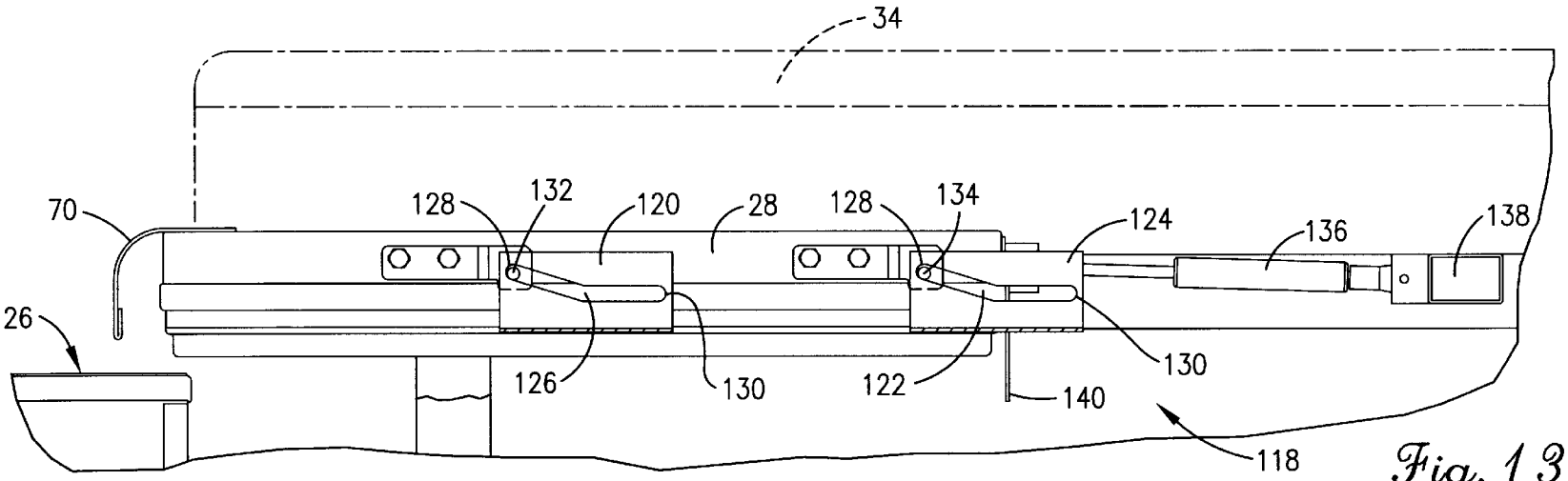
FIG. 13 is a fragmentary side view taken from the perspective of line 13—13 in FIG. 12 illustrating the lid in an upper open position.
Figure 14:
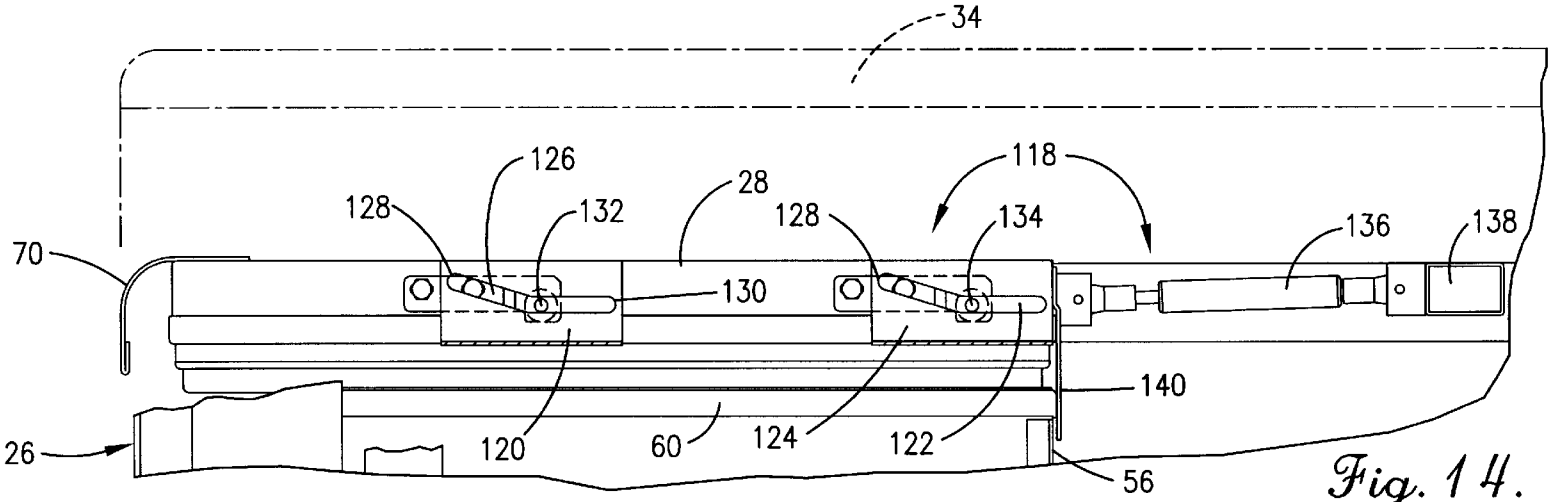
FIG. 14 is a fragmentary side view illustrating the lid in transition to a lower closed position.

Referring to FIGS. 10, 13, and 14, in an alternate embodiment, the opening mechanism comprises an automatic lid opening mechanism 118. The automatic opening mechanism 118 includes a pair of opposed forward flanges 120 attached to the top opposite side cross members 48 of the support frame 24. A pair of opposed rearward flanges 124 are also attached to the opposite side top cross members of the support frame. Each forward flange defines a forward slot 126, and each reward flange defines a rearward slot 122. Each slot 122, 126 has an upper end 128 and a lower end 130. The lower end 130 terminates a substantially horizontal portion of the slot, and the upper end 128 terminates a linearly inclined portion of the slot. The inclined portion of the slot inclines upwardly toward the front 54 of the refrigerator cabinet 26.

Figure 12:
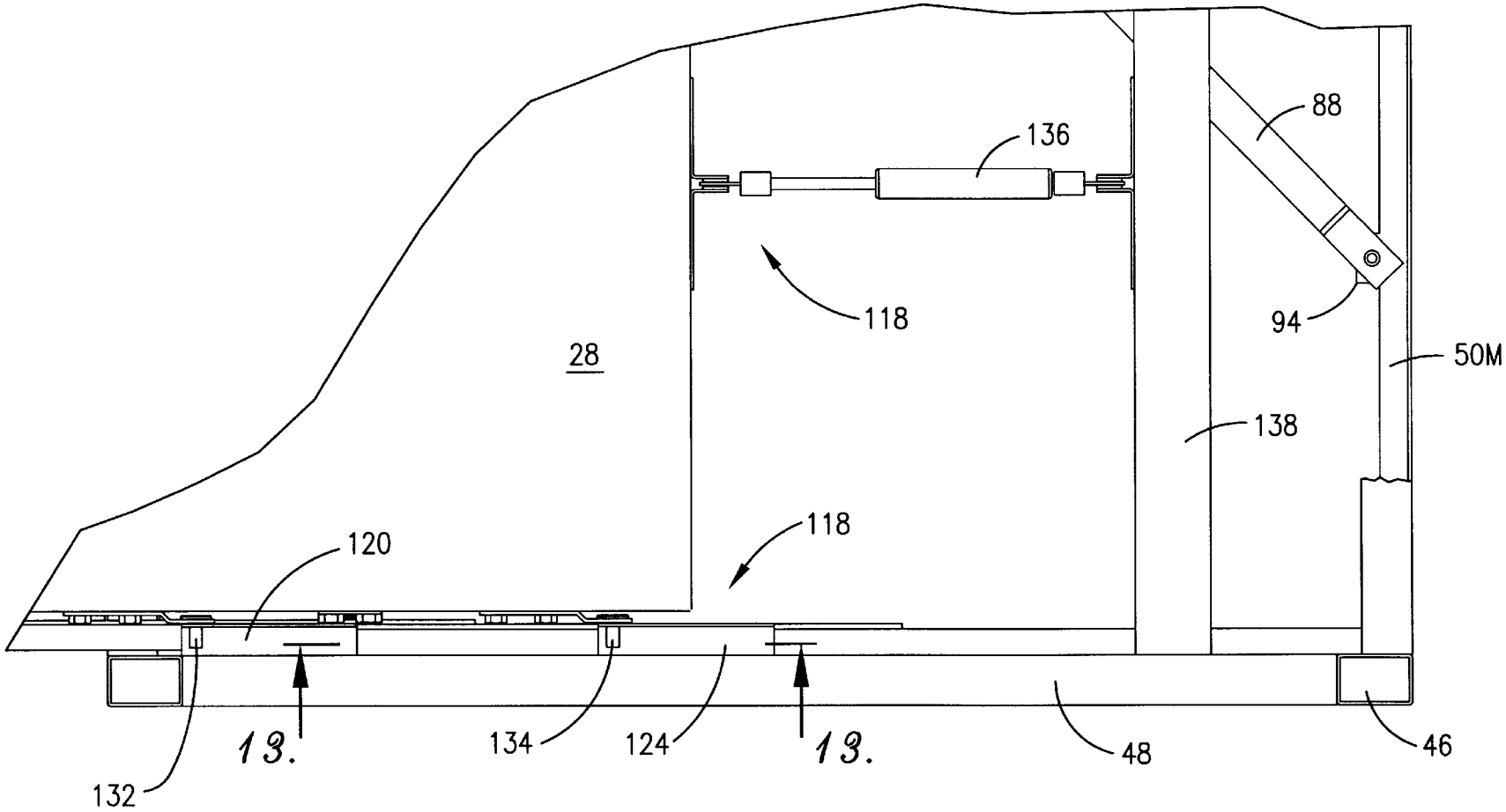
FIG. 12 is a fragmentary top view illustrating the automatic lid opening mechanism of FIG. 9.

Referring additionally to FIG. 12, a pair of forward roller pins 132 are mounted on opposite sides of the lid 28 and extend outwardly from the lid into the forward slots 126. A pair of rearward roller pins 134 are also attached to the opposite sides of the lid 28 and extend outwardly into the rearward slots 122. The pins are movably received in the slots. The spacing between the forward and rearward pins is substantially identical to the spacing between the forward and rearward slots, so that the pins are positioned at the same relative points within the slots.

Figure 9:
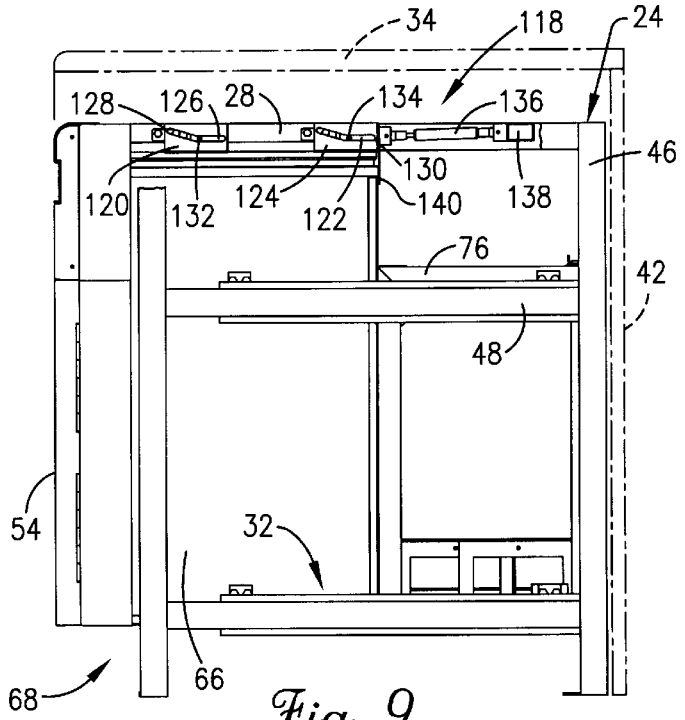
FIG. 9 is a side view of an under counter refrigeration unit having an automatic lid opening mechanism, according to the present invention.
Figure 11:
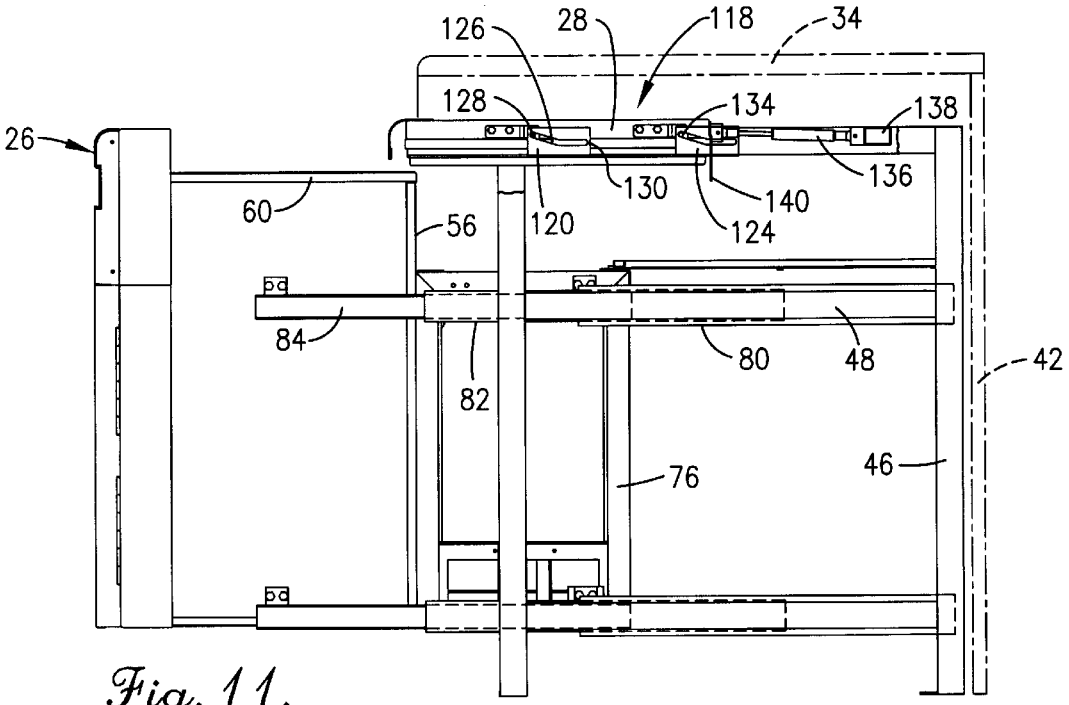
FIG. 11 is a side view of the under counter refrigeration unit of FIG. 9 illustrated in the accessible position.

Referring to FIGS. 9 and 10, at least one but preferably a pair of spring force biasing members 136 are attached to the rear of the lid and to a top cross member 138 of the support frame 24. The biasing members 136 force the lid forwardly toward an upper open position, still substantially under the counter top 34 as shown in FIGS. 10 and 11. Thus, the biasing members 136 are biased toward an extended position. The automatic opening mechanism 118 also includes a downwardly extending alignment catch 140 fixedly attached to the rear of the lid 28.

As the refrigeration unit 20 is pulled forwardly to the accessible position adjacent the counter top 34, the lid is pulled forwardly with the refrigerator cabinet 26 until the lid is lifted off the cabinet by the flanges and pins. Then, the the biasing members 136 continue to force the lid 28 forwardly until the pins 132, 134 are received in the upper ends of the inclined portion of the forward and rearward slots 122, 126. As the pins are moved toward the upper ends 128, the lid is lifted off of the top 60 of the refrigerator cabinet 26, thereby automatically opening the refrigerator cabinet 26. When the refrigerator cabinet is forced toward its stored position, the rear 56 of the cabinet engages the catch 140 overcoming the force of the biasing members 136 and forcing the pins 132, 134 toward the lower ends 130 of the forward and rearward slots 122, 126. As the pins are forced down the inclined portion of the slots 122, 126 the lid is moved downwardly until it closes the open top 60 of the refrigerator cabinet 26. The alignment catch 140 operates to properly align the lid 28 over the cabinet 26.

In operation, an operator grasps the handle 65 and pulls the refrigerator cabinet 26 and refrigeration system 30 out from underneath the counter top 34. In the embodiment shown in FIGS. 1 and 2, the operator then opens the lid 28, lifts the appropriate sub-lid 74 to gain access to the laboratory materials stored in the refrigeration unit 20. The sub-lid is then replaced, and the lid 28 is hingably closed. The operator then pushes the refrigerator cabinet into the stored position, in which the refrigeration unit 20 is positioned substantially entirely under the counter top 34. In the alternate embodiment shown in FIGS. 9, 10, and 11, the operator simply pulls the refrigerator cabinet and refrigerator system outwardly. The automatic lid opening mechanism 118 automatically lifts the lid 28 from the open top 60. Because the refrigeration unit is under the counter top 34 and because of the open toe kick space, the operator can work with the laboratory materials on the counter top directly above the stored refrigeration unit 20.

The under the counter refrigeration unit 20 according to the present invention provides conveniently located temperature controlled storage without using previously available floor space or counter top work area. Thus, the refrigeration unit, according to the present invention, can be installed at facilities which do not have sufficient space for installation of prior refrigeration units.

Thus, an under the counter refrigeration unit is disclosed which utilizes a slide mechanism to move the refrigeration unit between a stored position under a laboratory counter and an accessible position adjacent the laboratory counter thereby allowing the refrigeration unit to be utilized at facilities with insufficient space for previous refrigeration units. While preferred embodiments and particular applications of this invention have been shown and described, it is apparent to those skilled in the art that many other modifications and applications ofthis invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. An under the counter refrigeration unit providing controlled temperature storage for desired materials, the refrigeration unit comprising:

a refrigerator cabinet having a front, a rear, a top, a bottom, and defining an interior cavity for receiving materials to be stored;

a refrigeration system for controlling a temperature in the interior cavity and including controls operable to control the refrigeration system; and a slide mechanism operable to slidably support the refrigeration cabinet and at least part of the refrigeration system for sliding movement between a stored position under a counter top and an accessible position adjacent the counter top.

2. The refrigeration unit according to claim 1 further comprising a support frame for being fixedly mounted under a counter top, and the slide mechanism being operably coupled to the support frame, so that the refrigerator cabinet slides relative to the support frame between the stored and accessible positions.

3. The refrigeration unit according to claim 1 further comprising a lid and a lid opening mechanism openably coupling the lid with the top of the refrigerator cabinet.

4. An under the counter refrigeration unit providing controlled temperature storage for desired materials, the refrigeration unit comprising:

a refrigerator cabinet having a front, a rear, a top, a bottom, and defining an interior cavity for receiving materials to be stored;

a refrigeration system for controlling a temperature in the interior cavity and including controls operable to control the refrigeration system;

a slide mechanism operably coupled with the refrigerator cabinet for sliding the refrigerator cabinet between a stored position under a counter top and an accessible position adjacent the counter top; and a lid and a lid opening mechanism openably coupling the lid with the top of the refrigerator cabinet, wherein the opening mechanism comprises a manually operated hinge openably coupling the lid with the rear of the refrigerator cabinet.

5. An under the counter refrigeration unit providing controlled temperature storage for desired materials, the refrigeration unit comprsing:

a refrigerator cabinet having a front, a rear, a top, a bottom, and defining an interior cavity for receiving materials to be stored;

a refrigeration system for controlling a temperature in the interior cavity and including controls operable to control the refrigeration system;

a slide mechanism operably coupled with the refrigerator cabinet for sliding the refrigerator cabinet between a stored position under a counter top and an accessible position adjacent the counter top; and a lid and a lid opening mechanism openably coupling the lid with the top of the refrigerator cabinet, wherein the opening mechanism comprises an automatic lid opening mechanism.

6. The refrigeration unit according to claim 5 wherein the automatic lid opening mechanism includes opposed side flanges each defining a slot having an upper end and a lower end, opposed pins extending from opposite sides of the lid and being slidably received in the slots, so that the lid moves between an upper open position and a lower closed position.

7. The refrigeration unit according to claim 5 wherein the automatic lid opening mechanism includes opposed forward flanges each defining a forward slot and opposed rearward flanges each defining a rearward slot, each forward and rearward slot having upper ends and lower ends, four opposed pins extending from opposite sides of the lid and being movably received in the slots so that the lid moves between an upper open position and a lower closed position, and an alignment catch extending downwardly from the lid and engaging the rear of the refrigerator cabinet as the refrigerator cabinet slides rearwardly to the stored position thereby sliding the pins to the lower ends of the slots and closing the lid on the refrigerator cabinet.

8. The refrigeration unit according to claim 7 further comprising at least one biasing member connected to the lid to bias the lid toward the open position with the pins in the upper ends of the slots.

9. The refrigeration unit according to claim 3 wherein the lid is insulated and the refrigeration cabinet is insulated.

10. An under the counter refrigeration unit providing controlled temperature storage for desired materials, the refrigeration unit comprising:

a support frame for being fixedly mounted under a counter top;

an insulated refrigerator cabinet having a front, a rear, an open top, a bottom, and defining an interior cavity for receiving materials to be stored;

an insulated lid movable between a closed position closing the open top of the refrigerator cabinet and an open position allow access to the interior cavity of the refrigerator cabinet;

a refrigeration system for controlling a temperature in the interior cavity and including controls operable to control the refrigeration system; and a slide mechanism operable to slidably support the refrigeration cabinet and at least part of the refrigeration system for sliding movement between a stored position under a counter top and an accessible position adjacent the counter top.

11. The refrigeration unit according to claim 10 wherein the slide mechanism comprises a plurality of drawer slides.

12. The refrigeration unit according to claim 10 further comprising an anti-racking assembly interposed between the refrigerator cabinet and the support frame, and the anti-racking assembly being operable to inhibit rotation of the refrigerator cabinet relative to the support frame.

13. The refrigeration unit according to claim 10 wherein the refrigeration system is fixedly mounted relative to the refrigeration cabinet and slides with the refrigeration cabinet.

14. An under the counter refrigeration unit providing controlled temperature storage for desired materials, the refrigeration unit comprising:

a support frame for being fixedly mounted under a counter top;

an insulated refrigerator cabinet having a front, a rear, an open top, a bottom, and defining an interior cavity for receiving materials to be stored;

an insulated lid movable between a closed position closing the open top of the refrigerator cabinet and an open position allow access to the interior cavity of the refrigerator cabinet;

a refrigeration system for controlling a temperature in the interior cavity and including controls operable to control the refrigeration system; and a slide mechanism operably coupled with the refrigerator cabinet and the support frame for sliding the refrigerator cabinet between a stored position under the counter top and an accessible position adjacent the counter top, wherein the support frame includes a frame bottom and the refrigerator cabinet bottom is higher than the frame bottom to define a toe kick space below the refrigerator unit.

15. An under the counter refrigeration unit in combination with a laboratory counter including a counter top work surface and a support body holding the top work surface above a floor to define an open area under the top work surface, the combination providing controlled temperature storage for desired materials in a convenient location, the refrigeration unit comprising:

a support frame fixedly mounted under the counter top;

an insulated refrigerator cabinet having a front, a rear, an open top, a bottom, and defining an interior cavity for receiving materials to be stored;

an insulated lid movable between a closed position closing the open top of the refrigerator cabinet and an open position allow access to the interior cavity of the refrigerator cabinet;

a refrigeration system positioned under the counter top for controlling a temperature in the interior cavity of the refrigerator cabinet and including controls operable to control the refrigeration system; and a slide mechanism operable to slidably support the refrigeration cabinet and at least part of the refrigeration system for sliding movement between a stored position substantially entirely under the counter top and an accessible position adjacent the counter top.

16. An under the counter refrigeration unit in combination with a laboratory counter including a counter top work surface and a support body holding the top work surface above a floor to define an open area under the top work surface, the combination providing controlled temperature storage for desired materials in a convenient location, the refrigeration unit comprising:

a support frame fixedly mounted under the counter top;

an insulated refrigerator cabinet having a front, a rear, an open top, a bottom, and defining an interior cavity for receiving materials to be stored;

an insulated lid movable between a closed position closing the open top of the refrigerator cabinet and an open position allow access to the interior cavity of the refrigerator cabinet;

a refrigeration system positioned under the counter top for controlling a temperature in the interior cavity of the refrigerator cabinet and including controls operable to control the refrigeration system; and a slide mechanism operably coupled with the refrigerator cabinet and the support frame for sliding the refrigerator cabinet between a stored position substantially entirely under the counter top and an accessible position adjacent the counter top, wherein the support frame includes a frame bottom and the refrigerator cabinet bottom is higher than the frame bottom to define a toe kick space below the refrigerator unit.

17. The combination according to claim 16 further comprising an air intake adjacent a side of the refrigerator cabinet and an exhaust port positioned at the frame bottom for exhausting air through the toe kick space.

18. An under the counter refrigeration unit in combination with a laboratory counter including a counter top work surface and a support body holding the top work surface above a floor to define an open area under the top work surface, the combination providing controlled temperature storage for desired materials in a convenient location, the refrigeration unit comprising:

a support frame fixedly mounted under the counter top;

an insulated refrigerator cabinet having a front, a rear, an open top, a bottom and defining an interior cavity for receiving materials to be stored;

an insulated lid movable between a closed position closing the open top of the refrigerator cabinet and an open position allow access to the interior cavity of the refrigerator cabinet;

a refrigeration system positioned under the counter top for controlling a temperature in the interior cavity of the refrigerator cabinet and including controls operable to control the refrigeration system; and a slide mechanism operably coupled with the refrigerator cabinet and the support frame for sliding the refrigerator cabinet between a stored position substantially entirely under the counter top and an accessible position adjacent the counter top, further comprising an automatic lid opening mechanism including opposed forward flanges attached to the support frame and each forward flange defining a forward slot and opposed rearward flanges attached to the support frame and each rearward flange defining a rearward slot, each forward and rearward slot having upper ends and lower ends, four opposed pins extending from opposite sides of the lid and being slidably received in the slots, so that the lid moves between an upper open position and a lower closed position, and an alignment catch extending downwardly from the lid and engaging the rear of the refrigerator cabinet as the refrigerator cabinet slides rearwardly to the stored position thereby sliding the pins to the lower ends of the slots and closing the lid on the refrigerator cabinet.

19. The combination according to claim 18 wherein a substantial portion of the lid is under the counter top when the lid is in the open position.

20. The combination according to claim 15 wherein the laboratory counter includes a back wall, and the refrigeration system is adjacent the back wall and between the back wall and the refrigerator cabinet.

* * * * *